US009161628B2

(12) United States Patent
Regev

(10) Patent No.: US 9,161,628 B2
(45) Date of Patent: Oct. 20, 2015

(54) ROCKING CHAIR APPARATUS

(75) Inventor: Yizhak Regev, Tel Aviv (IL)

(73) Assignee: AMINACH BEDDING AND FURNITURE MANUFACTURING LTD., Ramle (IL)

( * ) Notice: Subject to any disclaimer, the term of this patent is extended or adjusted under 35 U.S.C. 154(b) by 0 days.

(21) Appl. No.: 13/982,671

(22) PCT Filed: Sep. 12, 2012

(86) PCT No.: PCT/IL2012/050362
§ 371 (c)(1),
(2), (4) Date: Jul. 30, 2013

(87) PCT Pub. No.: WO2014/020585
PCT Pub. Date: Feb. 6, 2014

(65) Prior Publication Data

US 2015/0137570 A1 May 21, 2015

(30) Foreign Application Priority Data

Jul. 30, 2012 (IL) ..... 221179

(51) Int. Cl.
*A47C 3/02* (2006.01)
*A47C 3/027* (2006.01)
(Continued)

(52) U.S. Cl.
CPC ..... *A47C 3/027* (2013.01); *A47C 3/0255* (2013.01); *A47C 3/03* (2013.01); *A47C 1/034* (2013.01);
(Continued)

(58) Field of Classification Search
CPC .... A47C 3/02; A47C 3/0255; A47C 1/03272; A47C 1/034; A47C 3/027; A47C 1/035; A47C 1/0355; A47C 3/0252
USPC ..... 297/258.1, 259.2, 259.1, 259.4, 265.1, 297/271.4, 341, 269.1, 270.1, 270.2, 262.1, 297/DIG. 7, 272.1
See application file for complete search history.

(56) References Cited

U.S. PATENT DOCUMENTS 3,093,409 A * 6/1963 Fletcher ..... 297/89
3,371,958 A 3/1968 Caldemeyer et al.
(Continued)

FOREIGN PATENT DOCUMENTS

GB 679324 9/1952

OTHER PUBLICATIONS

An International Search Report and a Written Opinion both dated Jan. 15, 2013, which issued during the prosecution of Applicant's PCT/IL2012/050362.
(Continued)

*Primary Examiner* — Chi Q Nguyen
(74) *Attorney, Agent, or Firm* — Sughrue Mion, PLLC

(57) ABSTRACT

A rocking chair including a base portion having at least one retaining member, a rockable seat portion mounted upon the base portion, an axle mounted on the seat portion, the axle being arranged for pivotal movement about an axis, at least one toothed rack mounted upon the axle and arranged for pivotal movement about the axis between a locked closed position and a locked open position, the toothed rack having a multiplicity of forward facing grooves arranged for selectable retaining engagement with the at least one retaining member, the selectable retaining engagement being operative to selectably limit forward and rearward extents of the rocking movement, and at least one adjustable forward limiting member operative, to limit the extent of forward pivotal movement of the at least one toothed rack in the first plane to be rearward of a second plane which intersects the at least one retaining member.

14 Claims, 4 Drawing Sheets

(51) Int. Cl.

| | |
|---|---|
| ***A47C 3/03*** | (2006.01) |
| *A47C 1/035* | (2006.01) |
| *A47C 1/0355* | (2013.01) |
| *A47C 1/034* | (2006.01) |
| *A47C 3/025* | (2006.01) |
| *A47C 1/032* | (2006.01) |

(52) U.S. Cl.
CPC ..... *A47C 1/035* (2013.01); *A47C 1/0355* (2013.01); *A47C 1/03272* (2013.01); *A47C 3/02* (2013.01); *A47C 3/0252* (2013.01)

(56) References Cited

U.S. PATENT DOCUMENTS

| | | | | | |
|---|---|---|---|---|---|
| 3,379,473 | A | | 4/1968 | Mizelle | |
| 3,464,736 | A | * | 9/1969 | Mizelle | 297/84 |
| 3,537,747 | A | * | 11/1970 | Rogers, Jr. | 297/85 L |
| 3,730,585 | A | * | 5/1973 | Rogers et al. | 297/85 L |
| 3,926,472 | A | * | 12/1975 | Evans | 297/88 |
| 5,435,622 | A | * | 7/1995 | Fay et al. | 297/259.2 |
| 5,527,095 | A | * | 6/1996 | Marshall et al. | 297/270.1 |
| 5,570,930 | A | | 11/1996 | LaPointe | |
| 5,839,781 | A | | 11/1998 | Knape | |
| 5,954,392 | A | * | 9/1999 | Liss et al. | 297/85 L |
| 6,000,754 | A | * | 12/1999 | Lawson | 297/259.2 |
| 6,120,094 | A | | 9/2000 | Parent | |
| 6,213,551 | B1 | | 4/2001 | Desnoyers | |
| 6,231,120 | B1 | * | 5/2001 | Wiecek | 297/84 |
| 6,244,658 | B1 | | 6/2001 | Parent | |
| 6,402,242 | B1 | | 6/2002 | Bellefleur | |
| 6,997,510 | B2 | | 2/2006 | Guillot | |
| 7,021,711 | B1 | * | 4/2006 | Hoffman et al. | 297/270.1 |
| 7,275,789 | B2 | * | 10/2007 | LaPointe | 297/258.1 |
| 7,431,387 | B2 | * | 10/2008 | LaPointe et al. | 297/68 |
| 8,096,614 | B2 | * | 1/2012 | Lin | 297/270.4 |
| 8,459,732 | B2 | * | 6/2013 | LaPointe et al. | 297/85 M |
| 8,926,009 | B1 | * | 1/2015 | LaPointe | 297/85 M |
| 2006/0249992 | A1 | * | 11/2006 | LaPointe et al. | 297/68 |
| 2007/0085395 | A1 | * | 4/2007 | LaPointe | 297/258.1 |
| 2007/0096522 | A1 | | 5/2007 | Bergeron | |
| 2011/0148161 | A1 | | 6/2011 | Fontaine | |

OTHER PUBLICATIONS

Communication dated Sep. 29, 2014 which issued by the European Patent Office in counterpart Application No. 12866998.

* cited by examiner

ROCKING CHAIR APPARATUS

FIELD OF THE INVENTION

The present invention relates generally to rocking chair mechanisms.

BACKGROUND OF THE INVENTION

The following publications are believed to represent the current state of the art:

U.S. Pat. Nos. 3,379,473; 5,839,781; 6,120,094; 6,213,551; 6,244,658; 6,402,242 and 6,997,510; and U.S. Published Patent Application Nos.: 2007/0096522 and 2011/0148161.

SUMMARY OF THE INVENTION

The present invention seeks to provide an improved rocking chair.

There is thus provided in accordance with a preferred embodiment of the present invention a rocking chair including a base portion having at least one retaining member, a rockable seat portion mounted upon the base portion, the rockable seat portion being arranged for forward and rearward rocking movement relative to the base portion, an axle mounted on the seat portion, the axle being arranged for pivotal movement about an axis, the axis spanning the width of the seat portion, the axis being generally parallel to the base portion, at least one toothed rack mounted upon the axle, the toothed rack being arranged for pivotal movement, together with the axle, about the axis between a locked closed position and a locked open position, the pivotal movement being in a first plane which is perpendicular to the axis, the toothed rack having a multiplicity of forward facing grooves arranged for selectable retaining engagement with the at least one retaining member, the selectable retaining engagement being operative to selectably limit forward and rearward extents of the rocking movement, and at least one adjustable forward limiting member, the at least one adjustable forward limiting member being operative, when the toothed rack is not in retaining engagement with the at least one retaining member, to limit the extent of forward pivotal movement of the at least one toothed rack in the first plane to be rearward of a second plane which intersects the at least one retaining member and which is generally perpendicular to the base portion and to the first plane.

Preferably, the rockable seat portion includes at least one rocking element, the base portion includes at least one biasing element, and the rocking element is rockably mounted on the biasing element.

Preferably, the at least one adjustable forward limiting member is mounted on the seat portion. Preferably, the at least one adjustable forward limiting member is adjustably mounted on the seat portion. Preferably, the adjustable forward limiting member is operable for adjustable positioning relative to the seat portion by screwing thereof inward or outward relative to the seat portion.

Preferably, the at least one retaining member is mounted on the base portion. Alternatively, the at least one retaining member is integrally formed with the base portion.

Preferably, the base portion and the seat portion are together enclosed by a combination of cushioning and upholstery.

In accordance with a preferred embodiment of the present invention, the chair also includes a user-operated locking handle mounted on a first end of the axle, the user-operated locking handle being operable for user rotation of the axle and the toothed racks mounted thereupon between the locked closed position and the locked open position. Preferably, locking of the axle and the racks in the locked open position and in the locked closed position is facilitated by an eccentric locking element.

Preferably, forward rotation of the locking handle is operative to rotate the axle together with the toothed racks mounted thereupon from the locked closed position to the locked open position in which the at least one toothed rack is disengaged from the at least one retaining member, thereby allowing a user of the rocking chair to rock the seat portion forward and rearward relative to the base portion, and to thereby align a selected one of the grooves of each of the at least one toothed rack with a corresponding one of the at least one retaining member. Preferably, the chair also includes a rearward limiting member, the rearward limiting member being operable for rearward limiting engagement of the at least one toothed rack therewith when in said open position.

Additionally, rearward rotation of the locking handle is operative to rotate the axle together with the toothed racks mounted thereupon from the locked open position to the locked closed position in which each of the at least one toothed rack is engaged with a corresponding one of the at least one retaining member via a selected one of the grooves, thereby fixing the resting angle of the seat portion relative to the base portion.

Alternatively, rearward rotation of the locking handle is operative to rotate the axle together with the toothed racks mounted thereupon from the locked open position to the locked closed position in which at least one of the at least one toothed rack is not engaged with a corresponding one of the at least one retaining member via the grooves.

Preferably, the resting angle of the seat portion relative to the base portion is operative to selectably limit the forward and rearward extents of the rocking movement of the seat portion relative to the base portion.

BRIEF DESCRIPTION OF THE DRAWINGS

The present invention will be understood and appreciated more fully from the following detailed description taken in conjunction with the drawing in which.

DETAILED DESCRIPTION OF PREFERRED EMBODIMENTS

Figure 1A:
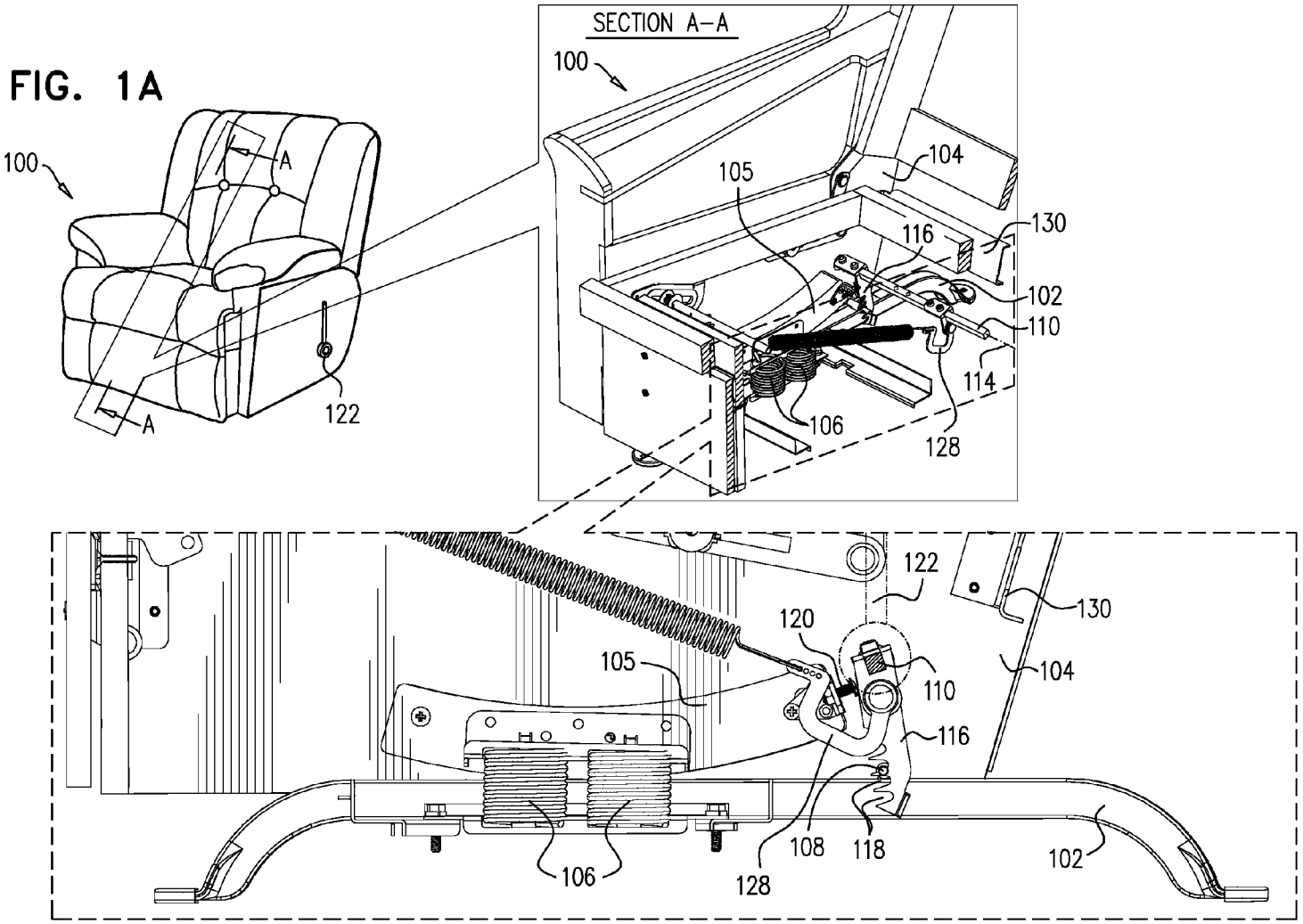
FIGS. 1A and 1B are simplified pictorial and sectional view illustrations of a rocking chair in respective locked closed and locked opened positions, constructed and operative in accordance with a preferred embodiment of the invention.
Figure 1B:
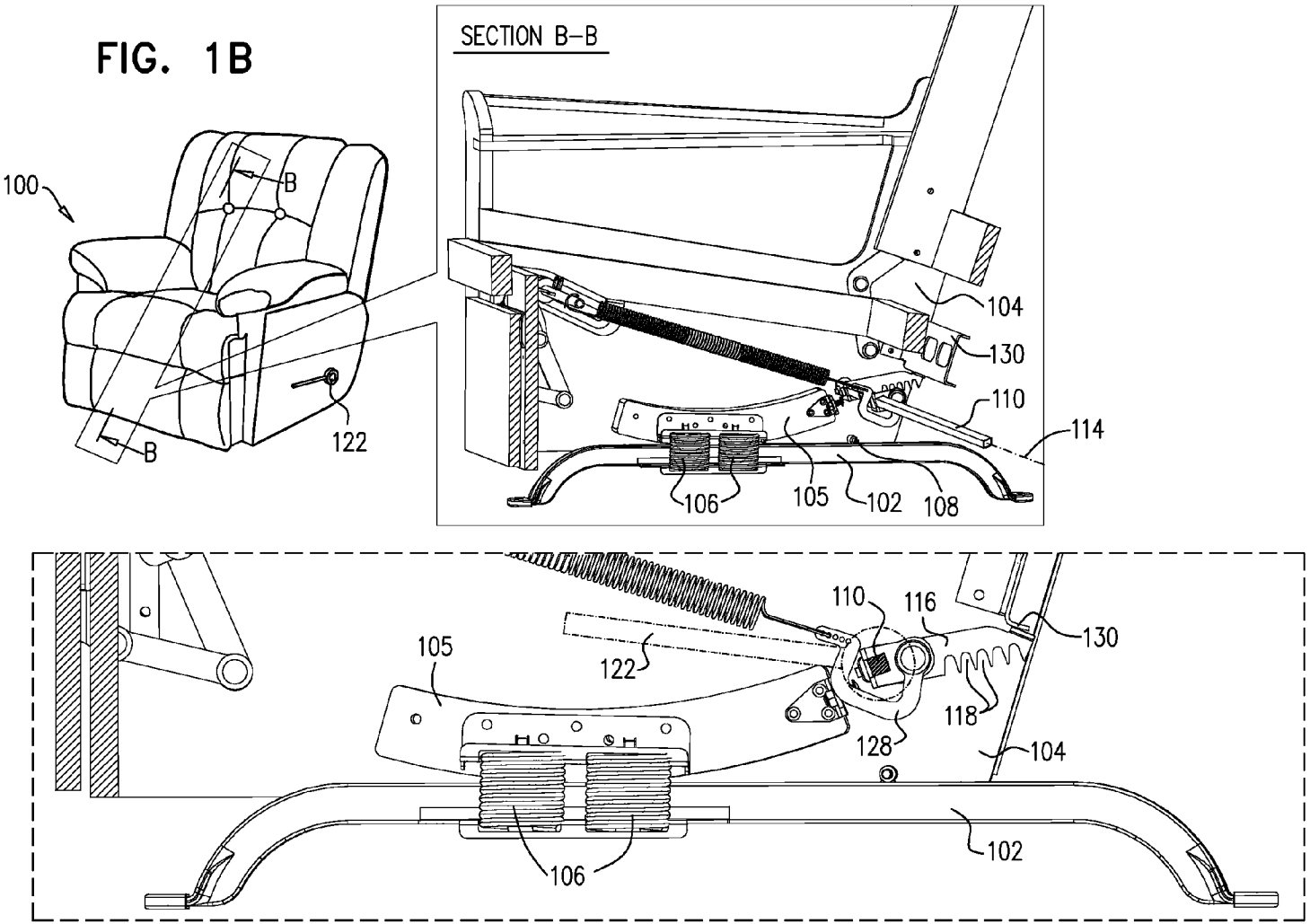

Reference is now made to FIGS. 1A and 1B, which are simplified pictorial and sectional view illustrations of a rocking chair in respective locked closed and locked opened positions, constructed and operative in accordance with a preferred embodiment of the invention. The rocking chair 100 preferably includes a base portion 102 and a rockable seat portion 104. A rocking element 105 of rockable seat portion 104 is preferably rockably mounted on at least one biasing element 106 of base portion 102, thereby providing for forward and rearward rocking movement of rockable seat portion 104 relative to base portion 102. Base portion 102 and seat portion 104 are preferably together enclosed by a combination of cushioning and upholstery.

Preferably, base portion 102 has at least one, and preferably two, retaining members 108. Retaining members 108 may be mounted on base portion 102 or, alternatively, integrally formed therewith.

An axle 110 is preferably mounted on base portion 102, axle 110 being arranged for pivotal movement about an axis 114, axis 114 spanning the width of the seat portion generally parallel to the base portion. At least one, and preferably two toothed racks 116 are preferably mounted upon axle 110. Toothed racks 116 are preferably arranged for pivotal movement, together with axle 110, about axis 114, between the locked closed position of FIG. 1A and the locked open position of FIG. 1B. The pivotal movement is preferably in a first plane which is perpendicular to axis 114.

Each of toothed racks 116 are preferably formed with a multiplicity of forward facing grooves 118 arranged for selectable retaining engagement of corresponding toothed racks 116 with corresponding retaining members 108, the selectable retaining engagement being operative to selectably limit forward and rearward extents of the rocking movement of seat portion 104 relative to base portion 102.

It is a particular feature of the present invention that chair 100 also includes an adjustable forward limiting member 120 mounted on seat portion 104, which adjustable forward limiting member 120 is preferably operative to adjustably limit the extent of forward pivotal movement of toothed rack 116 in the first plane to be rearward of retaining members 108, and to prevent toothed racks 116 from attaining a position which is forward of retaining members 108. Positioning of toothed racks 116 forward of retaining members 108 would allow for unchecked rocking movement of seat portion 104 relative to base portion 102. As shown in FIG. 1A, the position of adjustable forward limiting member 120 may be adjusted by screwing adjustable forward limiting member 120 inward and outward with regard to seat portion 104.

A user-operated locking handle 122 is preferably mounted on a first end of axle 110, and is operable for user rotation of axle 110 and toothed racks 116 mounted thereupon between the locked closed position of FIG. 1A and the locked open position of FIG. 1B. Locking of locking handle 122, axle 110 and racks 116 in either of the locked closed position of FIG. 1A and the locked open position of FIG. 1B is preferably facilitated by an eccentric locking element 128.

It is appreciated that forward rotation of locking handle 122 is operative to rotate axle 110 and to thereby rotate toothed racks 116 mounted thereupon from the locked closed position of FIG. 1A rearwardly and upwardly to the locked open position of FIG. 1B in which toothed racks 116 are disengaged from corresponding retaining members 108 and preferably engage a rearward limiting member 130. In the open position of FIG. 1B, a user of rocking chair 100 may freely rock seat portion 104 forward and rearward relative to base portion 102, and may thereby align a selected one of grooves 118 of each of toothed racks 116 with a corresponding retaining member 108.

It is also appreciated that rearward rotation of locking handle 122 is operative to rotate axle 110 and to thereby rotate toothed racks 116 mounted thereupon from the locked open position of FIG. 1B forwardly and downwardly to the locked closed position of FIG. 1A in which toothed racks 116 are engaged with corresponding retaining members 108 via the selected ones of grooves 118, thereby fixing the resting angle of seat portion 104 relative to base portion 102.

As further shown in FIG. 1A, racks 116 are engaged with corresponding retaining members 108 via generally medial ones of grooves 118, thereby fixing the resting angle of seat portion 104 relative to base portion 102 to be generally moderate.

Figure 2:
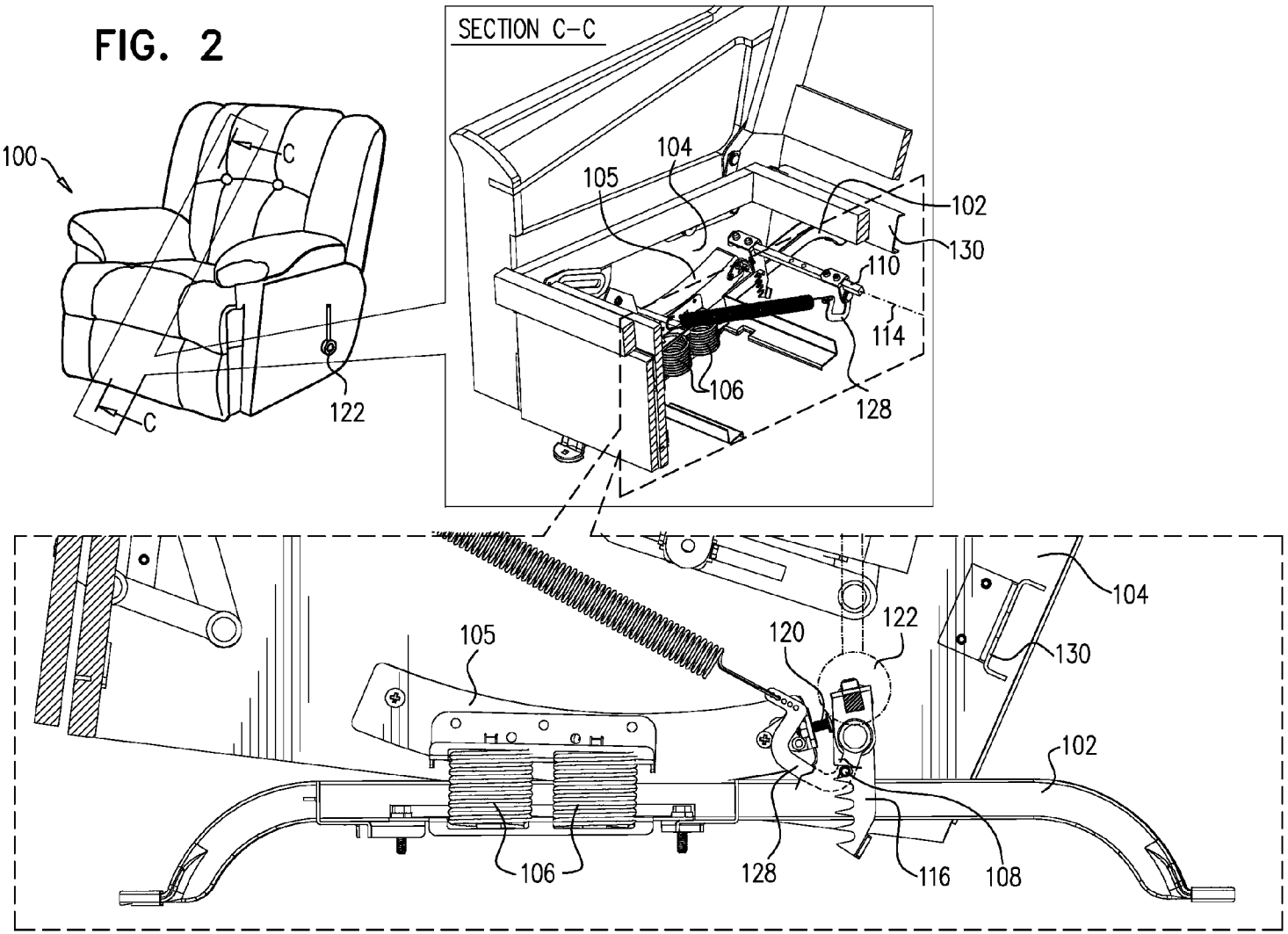
FIG. 2 is a simplified respective pictorial and sectional view illustration of another locked closed position of the rocking chair of FIGS. 1A and 1B.

Reference is now made to FIG. 2, which is a simplified respective pictorial and sectional view illustration of another locked closed position of the rocking chair of FIGS. 1A and 1B. In the orientation of FIG. 2, locking handle 122, axle 110 and toothed racks 116 are in a locked closed position wherein racks 116 are engaged with corresponding retaining members 108 via topmost ones of grooves 118, thereby lowering a rearward end of seat portion 104 relative to a forward end of seat portion 104, and thereby fixing the resting angle of seat portion 104 relative to base portion 102 to be generally extreme.

Figure 3:
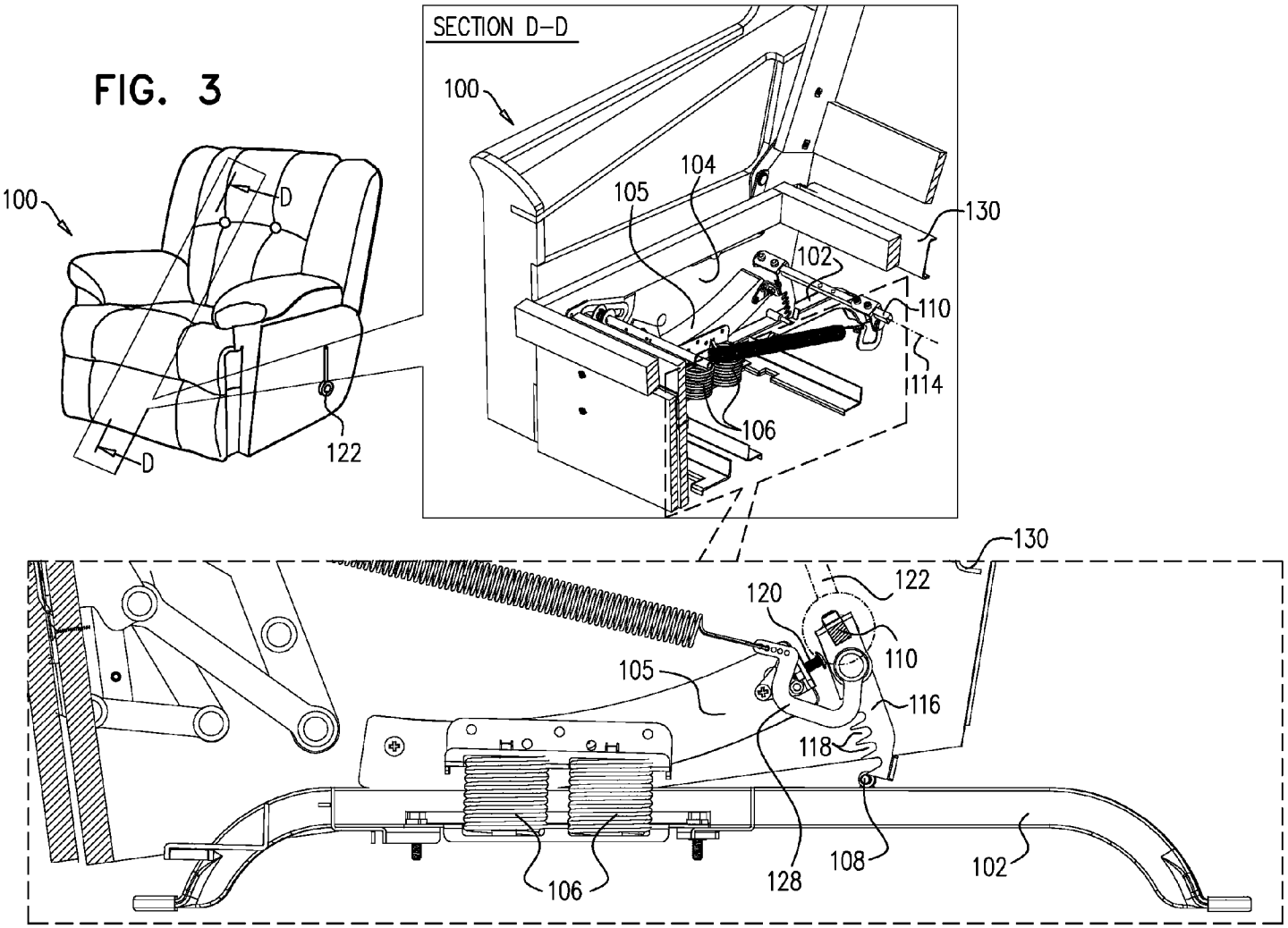
FIG. 3 is a simplified respective pictorial and sectional view illustration of yet another locked closed position of the rocking chair of FIGS. 1A and 1B.

Reference is now made to FIG. 3, which is a simplified respective pictorial and sectional view illustration of yet another locked closed position of the rocking chair of FIG. 1A. In the orientation of FIG. 3, locking handle 122, axle 110 and toothed racks 116 are in a locked closed position, however none of grooves 118 of racks 116 are engaged with corresponding retaining members 108.

As mentioned hereinabove, it is a particular feature of the present invention that adjustable forward limiting member 120 is operative to limit the extent of forward rotation of axle 110 together with toothed racks 116 mounted thereupon when disengaged from corresponding retaining members 108, thereby preventing toothed racks 116 from attaining a position which is forward of retaining members 108. Positioning of toothed racks 116 forward of retaining members 108 would allow for unchecked rocking movement of seat portion 104 relative to base portion 102.

It will be appreciated by persons skilled in the art that the present invention is not limited by what has been particularly shown and described hereinabove. Rather, the invention also includes various combinations and subcombinations of the features described hereinabove as well as modifications and variations thereof, which would occur to persons skilled in the art upon reading the foregoing and which are not in the prior art.

The invention claimed is:

1. A rocking chair comprising:

a base portion having at least one retaining member and at least one biasing element;

a rockable seat portion mounted upon said base portion, said rockable seat portion being arranged for forward and rearward rocking movement relative to said base portion, said rockable seat portion including at least one rocking element, said at least one rocking element being rockably mounted on said at least one biasing element;

an axle mounted on said seat portion, said axle being arranged for pivotal movement about an axis, said axis spanning a width of said rockable seat portion, said axis being generally parallel to said base portion;

at least one toothed rack mounted upon said axle, said at least one toothed rack being arranged for pivotal movement, together with said axle, about said axis between a locked closed position and a locked open position, said pivotal movement being in a first plane which is perpendicular to said axis, said at least one toothed rack having a multiplicity of forward facing grooves arranged for selectable retaining engagement with said at least one retaining member, said selectable retaining engagement being operative to selectably limit forward and rearward extents of said rocking movement; and at least one adjustable forward limiting member, said at least one adjustable forward limiting member being operative, when said at least one toothed rack is not in retaining engagement with said at least one retaining member, to limit the extent of forward pivotal movement of said at least one toothed rack in said first plane to be rearward of a second plane which intersects said at least one retaining member and which is generally perpendicular to said base portion and to said first plane.

2. A rocking chair according to claim 1 and wherein said at least one adjustable forward limiting member is mounted on said seat portion.

3. A rocking chair according to claim 1 and wherein said at least one adjustable forward limiting member is adjustably mounted on said seat portion.

4. A rocking chair according to claim 1 and wherein said adjustable forward limiting member is operable for adjustable positioning relative to said seat portion by screwing thereof inward or outward relative to said seat portion.

5. A rocking chair according to claim 1 and wherein said at least one retaining member is mounted on said base portion.

6. A rocking chair according to claim 1 and wherein said at least one retaining member is integrally formed with said base portion.

7. A rocking chair according to claim 1 and wherein said base portion and said seat portion are together enclosed by a combination of cushioning and upholstery.

8. A rocking chair according to claim 1 further comprising a user-operated locking handle mounted on a first end of said axle, said user-operated locking handle being operable for user rotation of said axle and said at least one toothed rack mounted thereupon between said locked closed position and said locked open position.

9. A rocking chair according to claim 8 and wherein locking of said axle and said at least one toothed rack in said locked open position and in said locked closed position is facilitated by an eccentric locking element.

10. A rocking chair according to claim 8 and wherein forward rotation of said locking handle is operative to rotate said axle together with said at least one toothed rack mounted thereupon from said locked closed position to said locked open position in which said at least one toothed rack is disengaged from said at least one retaining member, thereby allowing a user of said rocking chair to rock said seat portion forward and rearward relative to said base portion, and to thereby align a selected one of said grooves of each of said at least one toothed rack with a corresponding one of said at least one retaining member.

11. A rocking chair according to claim 10 further comprising a rearward limiting member, said rearward limiting member being operable for rearward limiting engagement of said at least one toothed rack therewith when in said open position.

12. A rocking chair according to claim 8 and wherein rearward rotation of said locking handle is operative to rotate said axle together with said at least one toothed rack mounted thereupon from said locked open position to said locked closed position in which each of said at least one toothed rack is engaged with a corresponding one of said at least one retaining member via a selected one of said grooves, thereby fixing the resting angle of said seat portion relative to said base portion.

13. A rocking chair according to claim 12 and wherein said fixing of the resting angle of said seat portion relative to said base portion is operative to selectably limit said forward and rearward extents of said rocking movement of said seat portion relative to said base portion.

14. A rocking chair according to claim 8 and wherein rearward rotation of said locking handle is operative to rotate said axle together with said at least one toothed rack mounted thereupon from said locked open position to said locked closed position in which at least one of said at least one toothed rack is not engaged with a corresponding one of said at least one retaining member via said grooves.

* * * * *